US008562372B2

(12) United States Patent
Sagdic et al.

(10) Patent No.: US 8,562,372 B2
(45) Date of Patent: Oct. 22, 2013

(54) ELECTRICAL PLUG CONNECTOR

(75) Inventors: Mehmet Sagdic, Detmold (DE); Stefan Giefers, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 166 days.

(21) Appl. No.: 13/147,845

(22) PCT Filed: Jan. 20, 2010

(86) PCT No.: PCT/EP2010/000305

§ 371 (c)(1),
(2), (4) Date: Aug. 4, 2011

(87) PCT Pub. No.: WO2010/089023

PCT Pub. Date: Aug. 12, 2010

(65) Prior Publication Data

US 2011/0294321 A1 Dec. 1, 2011

(30) Foreign Application Priority Data

Feb. 5, 2009 (DE) ..... 10 2009 007 596

(51) Int. Cl.
*H01R 13/627* (2006.01)

(52) U.S. Cl.
USPC ..... 439/352

(58) Field of Classification Search
USPC ..... 439/352–357
See application file for complete search history.

(56) References Cited

U.S. PATENT DOCUMENTS

| | | | | |
|---|---|---|---|---|
| 5,015,195 | A | 5/1991 | Piriz | |
| 5,342,215 | A * | 8/1994 | Silbernagel et al. | 439/357 |
| 6,254,418 | B1 * | 7/2001 | Tharp et al. | 439/352 |
| 6,537,099 | B2 * | 3/2003 | Herlinger et al. | 439/352 |
| 6,851,985 | B2 * | 2/2005 | Lafragette et al. | 439/701 |
| 2003/0040210 | A1 * | 2/2003 | Herlinger et al. | 439/352 |
| 2005/0130487 | A1 * | 6/2005 | Bartholoma et al. | 439/462 |
| 2011/0104925 | A1 | 5/2011 | Quiter et al. | |

FOREIGN PATENT DOCUMENTS

| | | | |
|---|---|---|---|
| DE | 29911792 | U1 | 10/1999 |
| DE | 10215194 | A1 | 10/2003 |
| DE | 10236275 | B3 | 1/2004 |
| DE | 202008013119 | U1 | 12/2008 |
| EP | 2017924 | A2 | 1/2009 |

* cited by examiner

*Primary Examiner* — Truc Nguyen
(74) *Attorney, Agent, or Firm* — Leydig, Voit & Mayer, Ltd.

(57) ABSTRACT

An electrical plug connector includes a first plug having a first clip and a second clip, and a second plug including a catch element, first and second releasing tabs and an unlatching element. At least one of the first clip and second clip is configured to engage the catch element. The first and second releasing tabs respectively contact the first and second clips in a plugged state of the electrical plug connector and are configured to release the respective clip from the catch element. The unlatching element surrounds the first and second releasing tabs in the plugged state of the electrical plug connector so as to contact the first releasing tab on a first side and to contact the second releasing tab on an opposing side. The unlatching element is displaceable in a direction transverse to a longitudinal axis of the electrical plug connector. In the plugged state, the connector is configured to receive a tool between the unlatching element and at least one of the first releasing tab and the second releasing tab.

17 Claims, 2 Drawing Sheets

ELECTRICAL PLUG CONNECTOR

CROSS REFERENCE TO RELATED APPLICATIONS

This application is a U.S. National Phase application under 35 U.S.C. §371 of International Application No. PCT/EP2010/000305, filed on Jan. 20, 2010, and claims benefit to German Patent Application No. DE 10 2009 007 596.8, filed on Feb. 5, 2009. The International Application was published in German on Aug. 12, 2010 as WO 2010/089023 A1 under PCT Article 21 (2).

FIELD

The invention relates to an electrical plug connector with a first plug and a second plug, wherein the first plug comprises a first clip and a second clip, and the second plug comprises a catch element, a first releasing tab, a second releasing tab and an unlatching element.

BACKGROUND

Electrical plug connectors are of great importance in various fields of application, such as industrial connection technology, serving, for example, to connect electrical components. Electrical plug connectors of the kind under discussion may preferentially be used in exterior applications and/or for the electrical connection of a photovoltaic system.

There are a various electrical plug connectors for the connection and/or interconnection of photovoltaic systems. Owing to the extremely high currents and voltages that can occur in the case of photovoltaic systems, and owing to their exterior application and the associated stresses from diverse atmospheric effects, electrical plug connectors of this kind are required, in addition to their ease of installation, to possess a sustained high degree of operational reliability.

SUMMARY

In an embodiment, the present invention provides an electrical plug connector including a first plug having a first clip and a second clip, and a second plug including a catch element, first and second releasing tabs and an unlatching element. At least one of the first clip and second clip is configured to engage the catch element. The first and second releasing tabs respectively contact the first and second clips in a plugged state of the electrical plug connector and are configured to release the respective clip from the catch element. The unlatching element surrounds the first and second releasing tabs in the plugged state of the electrical plug connector so as to contact the first releasing tab on a first side and to contact the second releasing tab on an opposing side. A tool is receivable between the unlatching element and at least one of the first releasing tab and the second releasing tab. The unlatching element is displaceable in a direction transverse to a longitudinal axis of the electrical plug connector.

BRIEF DESCRIPTION OF THE DRAWINGS

Exemplary embodiments of the present invention are explained in greater detail below, with reference to the drawings, in which.

DETAILED DESCRIPTION

Figure 1:
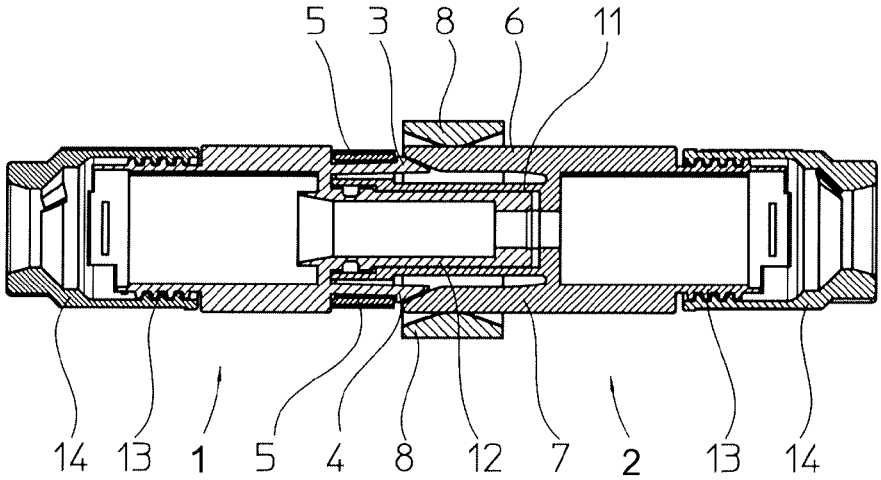
FIG. 1 shows a first sectional view of an electrical plug connector according to an embodiment of the invention in the plugged state.

In an embodiment the present invention provides an electrical plug connector that can be particularly simply and securely connected and/or released.

In an embodiment, the invention provides an electrical plug connector with a first plug and a second plug, wherein the first plug comprises a first clip and a second clip, and the second plug comprises a catch element, a first releasing tab, a second releasing tab and an unlatching element, wherein the first clip and/or the second clip can engage in the catch element, the first releasing tab contacts the first clip in the plugged state of the electrical plug connector such that the first clip can be released from the catch element by means of the first releasing tab, and the second releasing tab contacts the second clip in the plugged state of the electrical plug connector such that the second clip can be released from the catch element by means of the second releasing tab, the unlatching element encompasses the first releasing tab and the second releasing tab in the plugged state of the plug connector such that the unlatching element contacts the first releasing tab on one side and contacts the second releasing tab on the opposing side, the unlatching element is displaceable, especially slideable, transverse to the longitudinal axis of the electrical plug connector, and a tool can be inserted between the unlatching element and the first releasing tab and/or between the unlatching element and the second releasing tab.

In an embodiment, an electrical plug connector of this type having a first plug and a second plug is provided, wherein the first plug can be connected particularly simply and securely to the second plug, and the first plug can be particularly simply and securely released from the second plug. In other words, the locking and/or unlatching of the electrical plug connector according to the invention is particularly simple. For this purpose, the electrical plug connector is equipped with the first clip, the second clip and the catch element, which lock together when the first plug is connected to the second plug, preferably engaging in a self-locking, particularly form-fit and/or force-fit connection. Furthermore, the electrical plug connector enables the release of the first plug from the second plug by means of a tool, preferably a screwdriver.

In an embodiment, the unlatching element can contact the first releasing tab on one side and to contact the second releasing tab on the opposing side. Furthermore, a plurality of clips and/or releasing tabs may be provided, wherein the unlatching element contacts a proportion of the releasing tabs on one side, and contacts the remaining proportion of the releasing tabs on the opposing side, wherein any particular releasing tab is in contact with a clip.

An electrical plug connector of this kind is distinguished by its extreme simplicity of installation and its sustained high degree of operational reliability, particularly in exterior applications with the associated stresses from diverse atmospheric effects. In particular, the electrical plug connector according to the invention enables the secure and simple connection of the first plug to the second plug, and the secure and simple release of the first plug from the second plug, since the unlatching element on the one hand prevents any inadvertent release of the first plug from the second plug and, on the other, can be unlatched in a simple manner by means of the tool.

In an embodiment, the unlatching element is displaceable by pivoting the tool inserted between the unlatching element and the first releasing tab and/or between the unlatching element and the second releasing tab. In other words, pivoting the tool inserted between the unlatching element and the first releasing tab and/or between the unlatching element and the second releasing tab enables the release of the first plug from the second plug. The electrical plug connector thus enables a particularly simple unlatching of the first plug from the second plug by means of the tool, which preferably takes the form of a commercially-available screwdriver, but on the other hand, it also prevents any unlatching of the first plug from the second plug without the use of a tool, for example through any inadvertent manual operation or handling of the electrical plug connector.

By pivoting the tool inserted between the unlatching element and the first releasing tab and/or between the unlatching element and the second releasing tab, the unlatching element can be displaced transverse, preferably perpendicular, to the longitudinal axis of the electrical plug connector, i.e. for example transverse to the plug-in direction of the electrical plug connector, so that on one side the unlatching element displaces one of the releasing tabs towards the longitudinal axis of the electrical plug connector and, by means of the pivoting of the inserted tool, the other releasing tab can be displaced towards the longitudinal axis of the electrical plug connector, the first clip and the second clip thereby being releasable from the catch element so that the first plug can be released from the second plug. The tool can preferably be pivoted at an angle to the longitudinal axis of the electrical plug connector.

The unlatching element may in principle be configured as desired. According to an embodiment, however, provision is made for the unlatching element to be configured in such a way that a funnel-shaped recess for insertion of the tool is provided between the first releasing tab and the unlatching element and/or between the second releasing tab and the unlatching element. The funnel-shaped recess simplifies the insertion of the tool, particularly the tip of the tool, between the unlatching element and the releasing tab. The funnel-shaped recess further simplifies the pivoting of the inserted tool and thus the sliding of the unlatching element transverse to the longitudinal axis of the electrical plug connector. In other words, the funnel-shaped recess can create a first back-stop for the inserted tool, whereas a second back-stop for the inserted tool can be created by the first releasing tab or the second releasing tab.

In an embodiment a second funnel-shaped recess to be disposed in opposition to a first funnel-shaped recess. An embodiment of this kind means that the tool can be inserted between the unlatching element and the releasing tab both from one side and from the other, so that the first plug can be released from the second plug by means of the tool from both one side and the other.

The first clip and the second clip may in principle be configured as desired. In an embodiment, the invention provides that the first clip and/or the second clip takes the form of a latching hook. It is preferred for the latching hook to be executed as a lug-shaped latching hook extending radially outwards from the longitudinal axis of the electrical plug connector. An embodiment of this kind enables a particularly simple and secure locking of the clip with the catch element to be achieved.

The first clip and/or the second clip can be of a spring-action and/or flexibly deformable design. The first clip and/or the second clip is preferably acted upon with spring energy directed radially outwards. It is particularly preferred for the first clip and/or the second clip to take the form of a snap-in retainer.

According to an embodiment of the invention, it is further provided that, in the plugged state of the electrical plug connector, the first clip can, by displacement of the first releasing tab towards the longitudinal axis of the electrical plug connector, be released from the catch element, and/or the second clip can, by displacement of the second releasing tab towards the longitudinal axis of the electrical plug connector, be released from the catch element.

According to an embodiment of the invention, it is further provided that the first releasing tab and/or the second releasing tab can take the form of a spring-action and/or flexibly deformable cantilever arm. Moreover, the first releasing tab, in the plugged state of the electrical plug connector, can cover the first clip at least in part and/or for the second releasing tab, in the plugged state of the electrical plug connector, to cover the second clip at least in part. The clip and the releasing tab are each preferably equipped with a chamfer, wherein the chamfer of the clip contacts the chamfer of the releasing tab. An embodiment of this kind facilitates, in particular, the connecting of the first plug to the second plug, since, by virtue of the respective chamfers, the clip and the releasing tab can "slide over one another".

In an embodiment, the unlatching element, in the plugged state of the electrical plug connector, contacts the first releasing tab on one side, and to contact the second releasing tab on the symmetrically opposing side about the longitudinal axis of the plug connector. It is preferred for the first clip to contact the first releasing tab on one side and for the second clip to contact the second releasing tab on the symmetrically opposing side about the longitudinal axis of the plug connector. A symmetrical embodiment of this kind enables the manufacture of the electrical plug connector according to the invention to be particularly simple and cost-effective.

According to an embodiment of the invention, it is further provided for the unlatching element to be of a non-compressible design. Having a non-compressible unlatching ring ensures that the first plug cannot be released from the second plug by compressing the unlatching ring but only by using the tool. In other words, an embodiment of this kind for the unlatching element enables the avoidance of any inadvertent releasing of the first plug from the second plug by mechanical outside intervention.

The catch element may in principle be configured as desired. According to an embodiment of the invention, however, provision is made for the catch element to be configured in the form of a tunnel-shaped aperture. With an embodiment of this kind, when the first plug is being connected to the second plug, the first clip and/or the second clip can be "thrust" through the tunnel-shaped aperture, preferably engaging in the tunnel-shaped aperture.

According to an embodiment of the invention, it is further provided that the first plug and the second plug can be released from one another only by means of the tool. According to this embodiment of the invention, it can be ensured that the first plug and the second plug cannot be separated from one another manually or by some other mechanical outside intervention in, for example, exterior applications, and that to this extent they enter into a secure and stable combination. It is preferred if the first plug and the second plug can be connected together by positive and/or non-positive connection.

According to an embodiment of the invention, it is further provided that an electrical contact element is provided in the first plug and in the second plug respectively so that, when the first plug is connected to the second plug, an electrical connection can be made between the contact element in the first plug and the other contact element in the second plug. In this context, it is further preferred if the first plug is equipped with a sleeve and the second plug is equipped with a cylinder, and the cylinder can be inserted into the sleeve. With an embodiment of this kind, an extremely stable connection of the first plug to the second plug can be achieved.

It is further preferred for the electrical plug connector to be used for contacting a solar cell, a solar-cell module and/or a solar inverter. It is further preferred for the electrical contact element to be used for making electrical contact by means of the electrical contact element.

FIG. 1 to FIG. 4 show an electrical plug connector according to an embodiment of the invention in the plugged state, comprising a first plug 1 and a second plug 2.

The first plug 1 is equipped with a first clip 3 and a second clip 4, which respectively take the form of lug-shaped latching hooks, which are subjected to spring energy that is radially outwardly directed relative to the longitudinal axis of the electrical plug connector, and are to this extent of a spring-action and/or flexibly deformable design. The second plug 2 is equipped with a catch element 5, which takes the form of a tunnel-shaped aperture. When the first plug 1 is connected to the second plug 2, the first clip 3 and the second clip 4 are "thrust" through the catch element 5, configured as a tunnel-shaped aperture, and latch with the catch element 5, as shown in FIG. 1.

Figure 2:
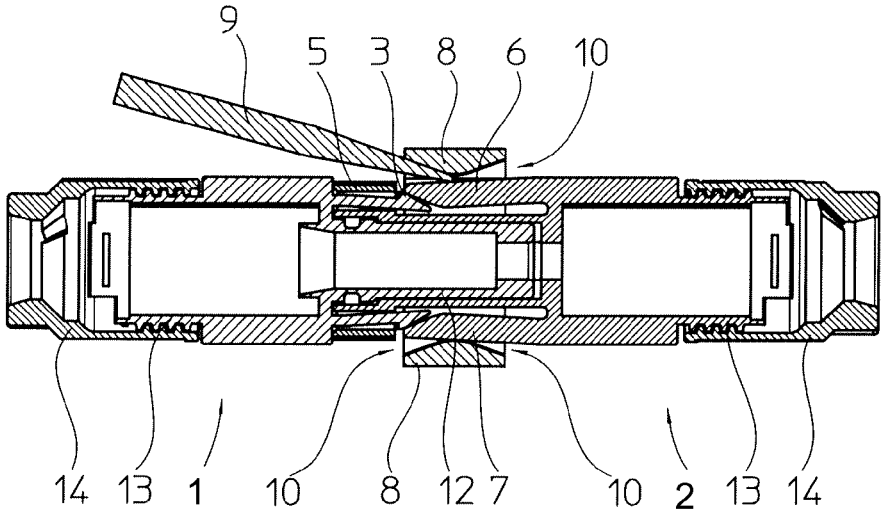
FIG. 2 shows a sectional view of the electrical plug connector a in the plugged state and the inserted tool.
Figure 3:
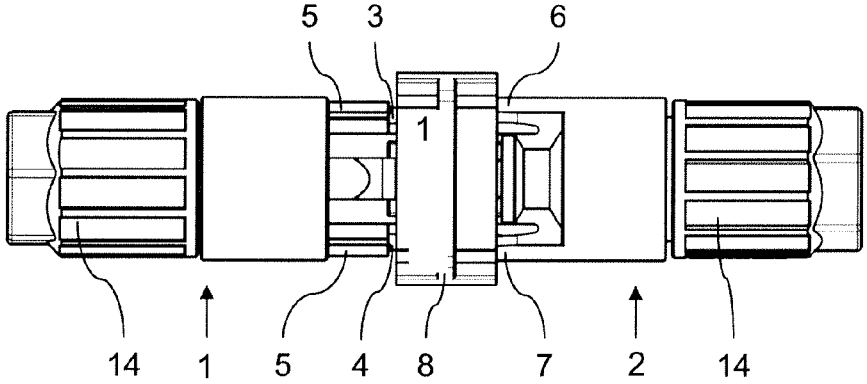
FIG. 3 shows a first side view of the electrical plug connector in the plugged state.
Figure 4:
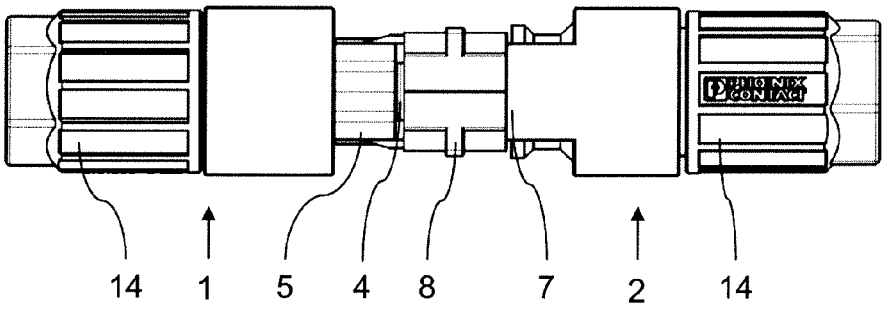
FIG. 4 shows a second side view of the electrical plug connector in the plugged state.

The first clip 3 along with a first releasing tab 6 that contacts the first clip 3, is disposed on one side of the electrical plug connector, whereas the second clip 4 and a second releasing tab 7 that contacts the second clip 4 are disposed on the symmetrically opposing side about the longitudinal axis of the electrical plug connector. The first releasing tab 6 and the second releasing tab 7 each take the form of a spring-action or flexibly deformable cantilever arm, wherein the first releasing tab 6 in part covers the first clip 3, and the second releasing tab 7 in part covers the second clip 4 in the plugged state of the electrical plug connector, as shown in FIG. 1 and FIG. 2. Just like the first clip 3 and the second clip 4, the first releasing tab 6 and the second releasing tab 7 are each equipped with a chamfer, wherein, in the plugged state of the electrical plug connector, the chamfer of the first clip 3 contacts the chamfer of the first releasing tab 6, and the chamfer of the second clip 4 contacts the chamfer of the second releasing tab 7.

The first clip 3 can be released from the catch element 5 by displacing the first releasing tab 6 towards the longitudinal axis of the electrical plug connector, and the second clip 4 can be released from the catch element 5 by displacing the second releasing tab 7 towards the longitudinal axis of the electrical plug connector, as shown in FIG. 2, so the first plug 1 can be released from the second plug 2.

As is further shown in FIGS. 1 to 4, an unlatching element 8 in the form of a ring encompasses the electrical plug connector in such a way that, in the plugged state of the electrical plug connector, the first releasing tab 6 contacts one side of the unlatching element 8 and the second releasing tab 7 contacts the unlatching element 8 on the opposing side.

As shown in FIG. 2, by inserting a tool 9 between the unlatching element 8 and the second releasing tab 7, the unlatching element 8 can be slid transverse to the longitudinal axis of the electrical plug connector. For this purpose, the unlatching element 8 is equipped with a funnel-shaped recess 10 for insertion of the tool 9 between the unlatching element 8 and the releasing tab 6, 7. Disposed in opposition to a first funnel-shaped recess 10 is a second recess 10 on the respective side of the unlatching element 8.

By pivoting the tool 9 inserted between the unlatching element 8 and the releasing element 6, 7, particularly pivoting the tool 9 about the longitudinal axis of the electrical plug connector, the unlatching element 8 can be slid transverse to the longitudinal axis of the electrical plug connector so that the first plug 1 can be released from the second plug 2.

As shown in FIG. 2, the pivoting of the tool 9 causes the unlatching element 8 to displace the first releasing tab 6 in the direction of the longitudinal axis of the electrical plug connector, thereby releasing the first clip 3 from the catch element 5, and, on the other hand, the tool 9 displaces the second releasing tab 7 in the direction of the longitudinal axis of the electrical plug connector, thereby releasing the second clip 4 from the catch element 5 so that the first plug 1 can be released from the second plug 2. In other words, the releasing of the first plug 1 from the second plug 2 can be accomplished by using a commercially-available tool 9, such as a screwdriver. On the other hand, the electrical plug connector according to the invention can be separated, i.e. the first plug 1 can be released from the second plug 2 only by using the tool 9, i.e. not manually.

The first plug 1 and the second plug 2 are also each equipped with an electrical contact element so that, by connecting the first plug 1 to the second plug 2, an electrical connection can be made between the contact element in the first plug 1 and the other contact element in the second plug 2. The first plug is further equipped with a sleeve 11 and the second plug is further equipped with a cylinder 12, wherein the cylinder 12 can be inserted into the sleeve 11 when the first plug 1 is connected to the second plug 2. An embodiment of this kind enables an extremely stable connection of the first plug to the second plug to be achieved. The first plug 1 and the second plug 2 are each further equipped with a screw thread 13 for attachment of a cap nut 14, wherein the cap nut 14 can fasten an electrical conductor, such as a cable, by means of fastening elements.

To sum up, an electrical plug connector is disclosed that can be used, for example, to connect, electrically and/or mechanically, a photovoltaic system and/or a solar panel, wherein the first plug 1 and the second plug 2 can be connected to and released from one another particularly simply and securely. The unlatching element 8 on the one hand ensures that the first plug 1 cannot be inadvertently released from the second plug 2 as a result of, for example, external mechanical influences, and on the other hand ensures, that the first plug 1 can be released from the second plug 2 only by using the tool 9.

While the invention has been particularly shown and described with reference to preferred embodiments thereof, it will be understood by those skilled in the art that various changes in form and details may be made therein without departing from the spirit and scope of the invention.

What is claimed is:

1. An electrical plug connector comprising:

a first plug including:

a first clip, and a second clip; and a second plug including:

a catch element configured to engage at least one of the first clip and second clip, a first releasing tab configured to contact the first clip in a plugged state of the electrical plug connector and configured to move the first clip so as to release the first clip from the catch element, a second releasing tab configured to contact the second clip in the plugged state of the electrical plug connector and configured to move the second clip so as to release the second clip from the catch element, and an unlatching element surrounding the first releasing tab and the second releasing tab in the plugged state of the electrical plug connector so as to contact the first releasing tab on a first side and contact the second releasing tab on an opposing side, a tool being receivable between the unlatching element and at least one of the first releasing tab and the second releasing tab, the unlatching element being displaceable in a direction transverse to a longitudinal axis of the electrical plug connector.

2. The electrical plug connector recited in claim 1 wherein the unlatching element is displaceable by a pivoting of the tool when the tool inserted between the unlatching element and at least one of the first releasing tab and the second releasing tab.

3. The electrical plug connector recited in claim 1, wherein the unlatching element provides a funnel-shaped recess for receiving the tool, the funnel-shaped recess being disposed between the unlatching element and the at least one of the first releasing tab and the second releasing tab.

4. The electrical plug connector recited in claim 3, wherein the unlatching element provides another funnel-shaped recess opposite the funnel-shaped recess.

5. The electrical plug connector recited in claim 1, wherein at least one of the first and second clip includes a latching hook.

6. The electrical plug connector recited in claim 1, wherein at least one of the first and second clip includes a spring-action clip.

7. The electrical plug connector recited in claim 1, wherein at least one of the first and second clip is flexibly deformable.

8. The electrical plug connector recited in claim 1, wherein, in the plugged state of the electrical plug connector, at least one of the first clip and the second clip is configured to be released from the catch element by displacement of the respective releasing tab toward the longitudinal axis of the electrical plug connector.

9. The electrical plug connector recited in claim 1, wherein at least one of the first releasing tab and the second releasing tab includes a spring-action cantilever arm.

10. The electrical plug connector recited in claim 1, wherein at least one of the first releasing tab and the second releasing tab includes a flexibly deformable cantilever arm.

11. The electrical plug connector recited in claim 1, wherein at least one of the first and second releasing tabs, in the plugged state of the electrical plug connector, at least partially covers the respective clip.

12. The electrical plug connector recited in claim 1, wherein the first side and the opposing side, at which the unlatching respectively contacts the first and second releasing tabs in the plugged state, are symmetrically opposing about the longitudinal axis of the plug connector.

13. The electrical plug connector recited in claim 1 wherein the unlatching element is non-compressible.

14. The electrical plug connector recited in claim 1 wherein the catch element includes a funnel-shaped aperture.

15. The electrical plug connector recited in claim 1, wherein the plug connector is configured so as to allow release of the first plug from the second plug only through the use of the tool.

16. The electrical plug connector recited in claim 1, wherein each of the first plug and second plug includes a respective electrical contact element configured to make an electrical connection upon connection of the first and second plugs.

17. A method of providing electrical connection to a solar element, the method comprising:

providing a solar element including at least one of a solar cell, a solar cell module and a solar inverter;

providing an electrical connector including:

a first plug having a first clip and a second clip; and a second plug including a catch element configured to engage at least one of the first clip and second clip, a first releasing tab configured to contact the first clip in a plugged state of the electrical plug connector and configured to release the first clip from the catch element, a second releasing tab configured to contact the second clip in the plugged state of the electrical plug connector and configured to release the second clip from the catch element, and an unlatching element surrounding the first releasing tab and the second releasing tab in the plugged state of the electrical plug connector so as to contact the first releasing tab on a first side and to contact the second releasing tab on an opposing side, a tool being receivable between the unlatching element and at least one of the first releasing tab and the second releasing tab, the unlatching element being displaceable in a direction transverse to a longitudinal axis of the electrical plug connector;

associating one of the first and second plugs of the electrical connector with the solar element; and connecting the first and second plugs so as to provide electrical contact of the solar element.

* * * * *